US008429812B2

(12) United States Patent
Yoshinaga et al.

(10) Patent No.: US 8,429,812 B2
(45) Date of Patent: Apr. 30, 2013

(54) METHOD OF MANUFACTURING A WIRE

(75) Inventors: Satoru Yoshinaga, Susono (JP); Toshiyuki Yamada, Susono (JP); Takanori Suzuki, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/699,237

(22) Filed: Feb. 3, 2010

(65) Prior Publication Data

US 2010/0200272 A1 Aug. 12, 2010

(30) Foreign Application Priority Data

Feb. 9, 2009 (JP) ..... P2009-027180

(51) Int. Cl.
*H01R 43/00* (2006.01)

(52) U.S. Cl.
USPC ..... 29/825; 29/605; 29/868; 29/869; 29/870; 29/871

(58) Field of Classification Search ..... 29/605, 29/825, 868, 869, 870, 871, 872
See application file for complete search history.

(56) References Cited

U.S. PATENT DOCUMENTS 3,383,704 A * 5/1968 Schoerner et al. ..... 57/215
3,444,684 A * 5/1969 Schoerner et al. ..... 57/9
4,473,995 A * 10/1984 Gentry ..... 57/9
4,980,972 A * 1/1991 Singh et al. ..... 29/872
5,496,969 A * 3/1996 Blackmore ..... 174/113 R
6,272,828 B1 * 8/2001 Walling et al. ..... 57/58.49
6,900,391 B1 5/2005 Maeda
7,060,907 B2 * 6/2006 Maeda ..... 174/128.1

FOREIGN PATENT DOCUMENTS

EP 1 783 784 A1 5/2007
JP 60-30043 B * 7/1985
JP 4-372313 A 12/1992
JP 11-283720 10/1999
JP 2006-32084 2/2006

OTHER PUBLICATIONS

Notification of First Office Action issued on Mar. 23, 2011 from the Chinese Patent Office in counterpart Chinese Application No. 201010111915.1 (5 pages).
Official Communication mailed Jul. 18, 2011, from German Patent Office in counterpart German Application No. 10 2010 001 664.0 (4 pages).

* cited by examiner

*Primary Examiner* — Carl Arbes
(74) *Attorney, Agent, or Firm* — Finnegan, Henderon, Farabow, Garrett & Dunner, LLP

(57) ABSTRACT

A manufacturing method of an ultrafine wire including a conductor formed from a plurality of wire, the method comprising: twisting three wires into a twisted wires; and forming the conductor by compressing the twisted wires through a compressing hole of a compressing die after the twisting. A ratio of a cross section of the conductor after compressing to an area of the compressing hole is 80% to 83%.

8 Claims, 5 Drawing Sheets

METHOD OF MANUFACTURING A WIRE

CROSS REFERENCE TO RELATED APPLICATIONS

The present application claims foreign priority from Japanese Patent Application No. 2009-027180 filed on Feb. 9, 2009, and the subject matter of which is incorporated herein by reference.

TECHNICAL FIELD

The present invention relates to an ultrafine wire and a manufacturing method of a conductor for the ultrafine wire.

BRIEF DESCRIPTION OF RELATED ART

A wire harness is disposed in a vehicle body such as an automobile. The wire harness is manufactured by bundling wires which are connected to electronic parts or the like mounted on the vehicle body. The wires are respectively connected to a terminal clasp at the end thereof. The terminal clasp is received in a connector housing which is provided for connecting the terminal clasp to the electrical parts. There are a lot of kinds of wires. For example, an ultrafine wire having a conductor cross sectional area (nominal cross sectional area) of 0.13 sq is used for the wire harness. (see for example JP-A-2006-32084)

The ultrafine wire is provided with the conductor and an insulator by which the conductor is coated. The conductor of the ultrafine wire includes a single core wire and a plurality of peri-wires singly lapping the core wire.

Incidentally, a connector provided at the end of the ultrafine wire is manufactured by the following manner. Firstly, the terminal clasp is connected to the end of the ultrafine wire. Secondly the terminal clasp is inserted into a space of the connector housing from the rear side of the connector housing while holding the insulator (coating) of the ultrafine wire. (See for example JP-A-H11-283720)

In the above described related arts, in a case where the conductor cross sectional area of the ultrafine wire is made smaller than 0.13 sq (in case of the structure of the above related art), since the diameter of the wire forming the conductor is smaller than 0.15 mm, there is a problem described below. The problem is that the ultrafine wire provided with a wire of the diameter smaller than 0.15 mm has a small buckling load.

The small buckling load of the ultrafine wire causes a situation described in FIG. 4 during the insertion of the terminal clasp into the space of the connector housing while holding the ultrafine wire. Since the ultrafine wire does not have enough strength, the ultrafine wire bends before the terminal clasp 2 is received in the space 4 of the connector housing 2. The ultrafine wire 1 of small strength is good in an aspect of the bending durability and flexibility. On the other hand, the ultrafine wire 1 of small strength has bad workability for the terminal insertion. This situation is, of course, not preferable.

In a case where the conductor is a single wire instead of the above described conductor structure with the plurality of wires, the ultrafine wire obtains a high rigidity and less tends to bend. Also, the form of the ultrafine wire is easily kept.

There is a problem, however, that the bending durability is deteriorated because of the high rigidity. Also, in this case, since the adhesion between the single wire and the insulator becomes small, a dimension for a coat stripping becomes unstable.

SUMMARY

The exemplary embodiment of the present invention addresses the above described problems and also may address the problems not described above. The exemplary embodiment of the present invention provides an ultrafine wire imparted a good workability for the terminal insertion, and secures good buckling characteristics. Also, the exemplary embodiment of the present invention provides a manufacturing method of the ultrafine wire.

An exemplary embodiment of the present invention is a manufacturing method of an ultrafine wire including a conductor formed from a plurality of wire, the method comprising: twisting three wires; and forming the conductor by compressing the twisted wires through a compressing hole of a compressing dies after the twisting. A ratio of a cross section of the conductor after compressing to an area of the compressing hole to is 80% to 83%.

Another exemplary embodiment of the present invention is an ultrafine wire comprising: a conductor manufactured by the method according to the above exemplary embodiment.

According to the above described exemplary embodiment, the conductor is manufactured by compressing the twisted three wires with the compressing die. The conductor is manufactured so that the ratio of a cross section of the conductor after compressing to an area of the compressing hole is 80% to 83%. The ultrafine wire provided with such a conductor less tend to be buckled during the terminal insertion into the connector housing. By adapting the manufacturing method of the above exemplary embodiment, the ultrafine wire obtains good workability for the terminal insertion and the buckling characteristics.

According to the above described exemplary embodiment, the ultrafine wire provided with the conductor manufactured by the above described method is better than that of related art. In other words, the ultrafine wire secures good workability for the terminal insertion by deterring buckling of the ultrafine wire during the terminal insertion into the connector housing, and secures good buckling characteristics.

According to the above described another exemplary embodiment, the ultrafine wire, which secures good workability for the terminal insertion by deterring buckling of the ultrafine wire during the terminal insertion into the connector housing, and secures good buckling characteristics, is provided.

BRIEF DESCRIPTION OF DRAWINGS

FIG. 1A is a cross sectional view of the ultrafine wire. FIG. 1B is a flow chart for the manufacturing method of the ultrafine wire.

DESCRIPTION OF EXEMPLARY EMBODIMENT

Figure 1A:
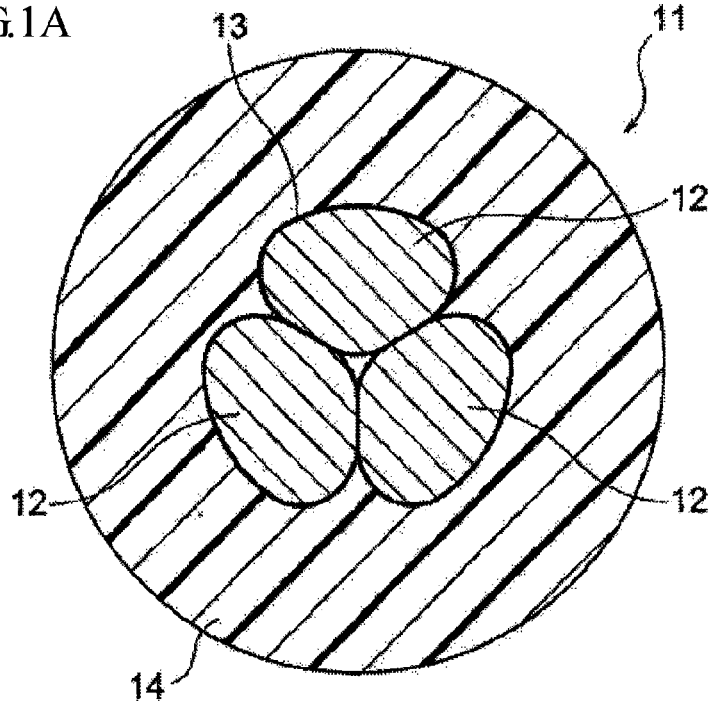
FIGS. 1A and 1B show an exemplary embodiment of an ultrafine wire and a manufacturing method of the ultrafine wire according to the present invention.
Figure 1B:
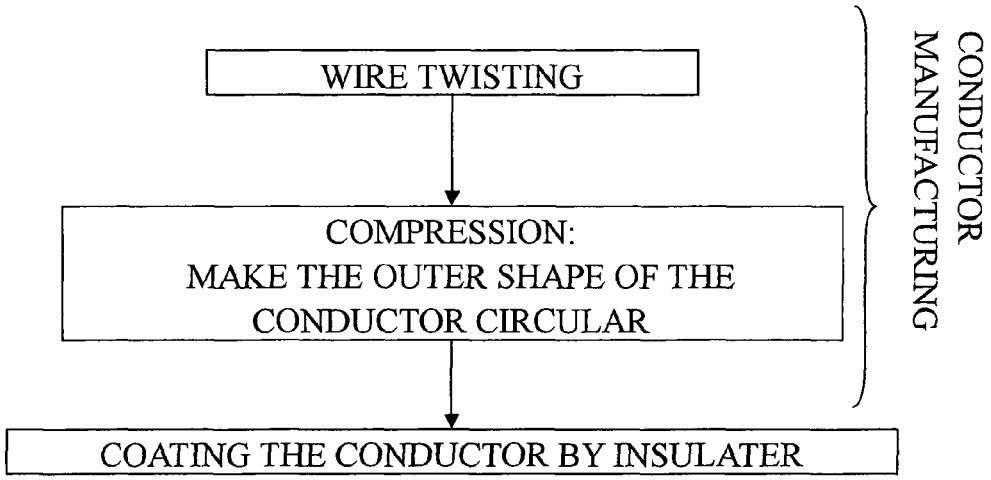

An exemplary embodiment of the present invention is described below with reference to drawings. FIGS. 1A and 1B show an exemplary embodiment of an ultrafine wire and a manufacturing method of the ultrafine wire according to the present invention. FIG. 1A is a cross sectional view of the ultrafine wire. FIG. 1B is a flow chart for the manufacturing method of the ultrafine wire.

FIG. 1A shows an ultrafine wire 11 of the exemplary embodiment. The ultrafine wire 11 is one component of a wire harness disposed in a vehicle such as an automobile and an example of a low voltage wire for the automobile. The ultrafine wire 11 is to be connected to a related terminal clasp (not shown) at an end thereof. The terminal clasp is one component of a connector. The connector is used for connecting the wire harness to an electronic parts or the like mounted on the vehicle. The terminal clasp is inserted into a space of a connector housing from rear side of the connector housing.

The ultrafine wire 11 has a buckling load larger than a force applied to the ultrafine wire 11 for inserting the terminal into the connector housing. Also, the ultrafine wire 11 is durable against repetitive application of load such as vibration and buckling. In order to achieve such characteristics, the ultrafine wire 11 has a configuration and a structure explained below. Firstly, the configuration and the structure of the ultrafine wire 11 are explained in below.

The ultrafine wire 11 is provided with a conductor 13 and an insulator 14. The conductor 13 is formed by twisting three wires 12. The conductor 13 is coated by the insulator 14. A non-limited example of the material used for the wire 12 is a tough-pitch copper purified from an electrolyte copper. The conductor 13 is manufactured by not only twisting the three wires 12 but also compressing the twisted wires with a compressing die (not shown). The compressing die has a hole (compressing dies hole) through which the outer shape of the twisted wires is compressed so as to be circular. The compressing condition of the compressing die is set so that the ratio (packing factor) of a cross section of the conductor 13 after the compression to an area of the hole is to be 80% to 83%

The packing factor 80% to 83% is determined from evaluations for the conditions of the conductor 13 while varying the packing factor. In a case where the compression is set so that the packing factor is 80% to 83%, the conductor 13 is prevented from unraveled (the wires 12 apart from each other) and is prevented from compressively broken. Therefore, the conductor 13 in good condition can be manufactured. The table 1 shows the advantage of the packing factor of 80% to 83%.

In table 1, the diameter of the compressing die hole (hole diameter), the area of the compressing die hole, a cross section of the conductor after compressed by the compressing die, and the packing factor. Also, table 1 shows whether a conductor with wires made from the annealed tough-pitch copper is suitable or not. Also, table 1 shows whether a conductor with wires made from the hard tough-pitch copper is suitable or not. Also, table 1 shows why these wires are not suitable in each case. As shown in table 1, if the conductor is compressed so that the packing factor is 80% to 83%, there is no unraveling or compressive break in the conductor regardless the material for the wire. The conductor was manufactured by twisting three wires (wire diameter 0.201 mm) made from the annealed tough-pitch copper or made from the hard tough-pitch copper and then compressing with the compressing dies which has the compressing die hole of a predetermined diameter. In the case of the wire made from the annealed tough-pitch copper, the packing factor of 80% to 93% is suitable. In the case of the wire made from the hard tough-pitch copper, the packing factor of 80% to 83% is suitable.

The insulator 14 is made from a resin and molded in a thickness (for example 0.2 mm) suitable for the low voltage wire for an automobile. Needless to say, it is possible to improve the buckling load of the ultrafine wire 11 by making the hardness (strength or elasticity) of the insulator 14 large.

Next, a manufacturing method for the ultrafine wire 11 and the conductor 13 is explained.

As shown in FIG. 1B, firstly the three wires 12 are twisted. Secondly, the twisted wires 12 are compressed by the compressing dies of a predetermined size so that the outer shape of the twisted wires 12 is circular. By this process, the conductor 13 shown in FIG. 1A is manufactured. After the conductor 13 is manufactured, the ultrafine wire 11 is manufactured by coating the conductor 13 by the insulator 14.

Since the conductor 13 has a larger outer surface area as compared to the case where only single wire is used, the insulator 14 is in a good intimate contact with the conductor 13.

Figure 2A:
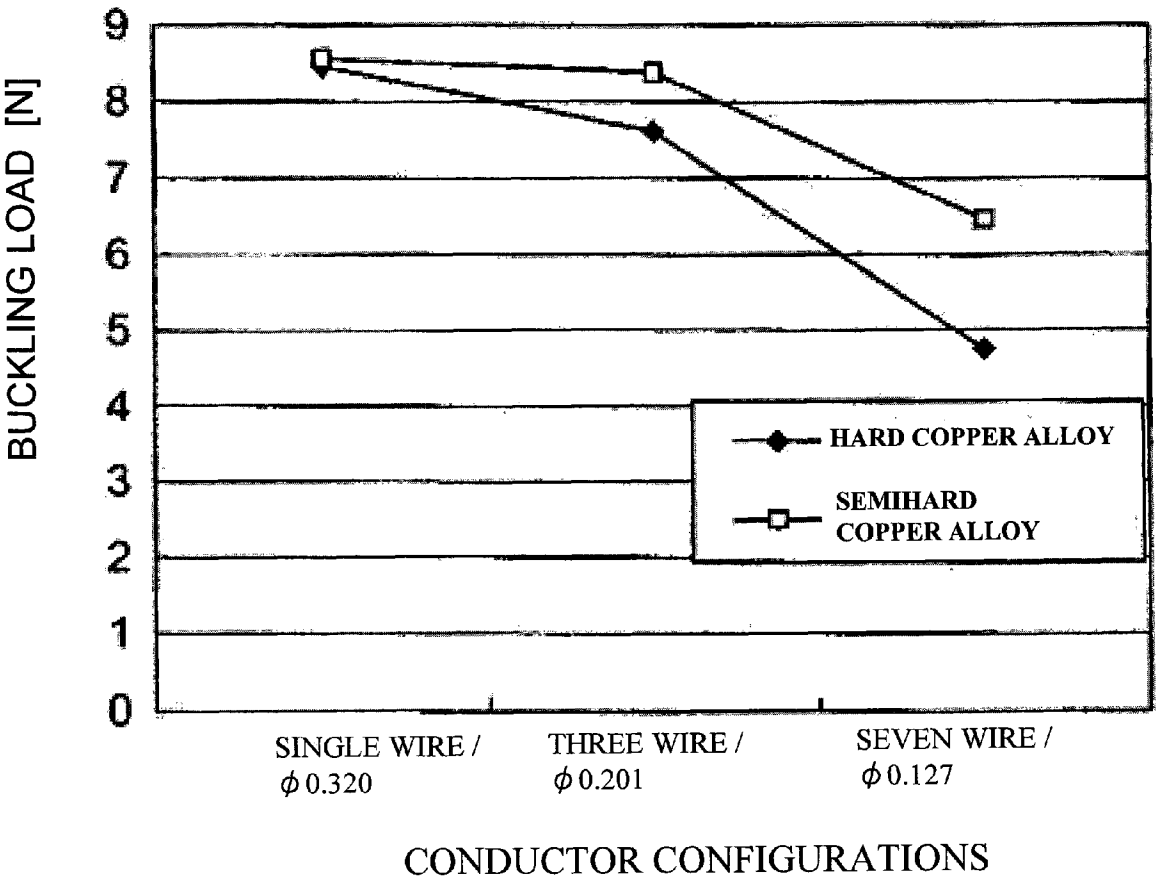
FIG. 2A is a graph showing a relationship between conductor configurations and respective buckling load.
Figure 2B:
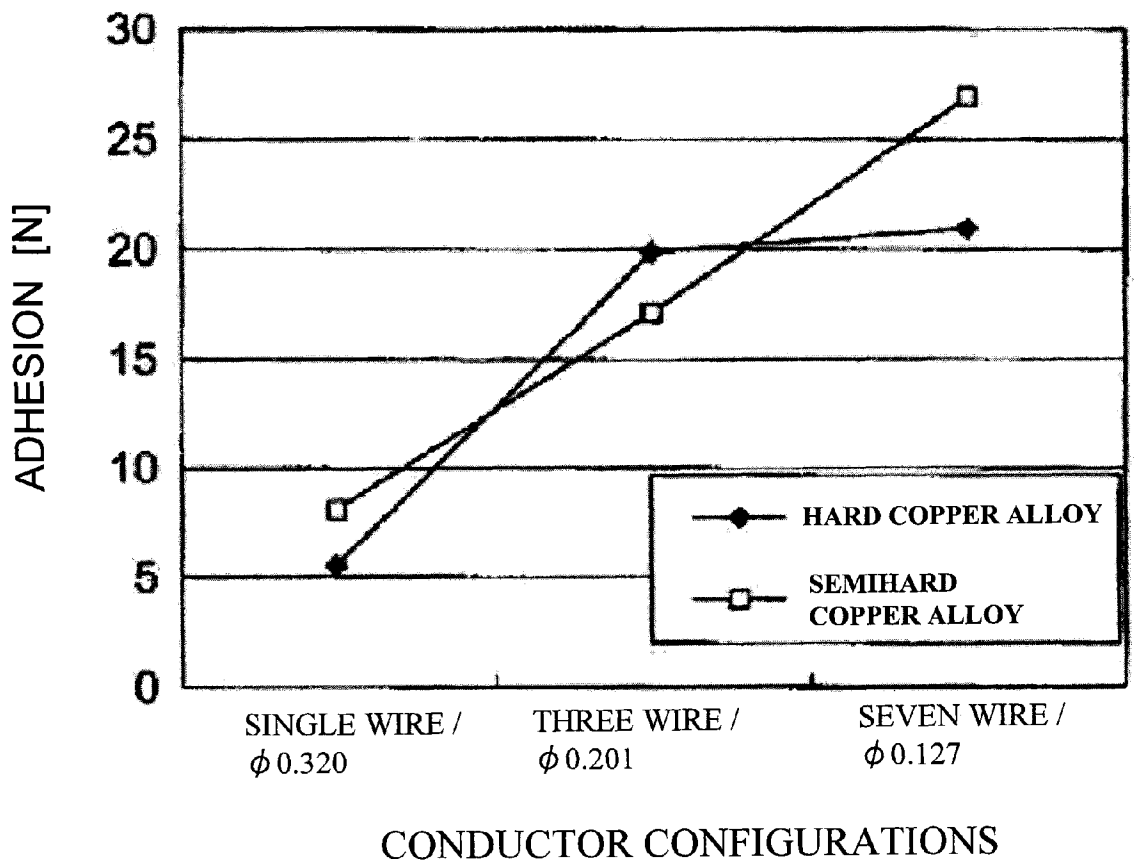
FIG. 2B is a graph showing a relationship between conductor configurations and respective adhesion.
Figure 3:
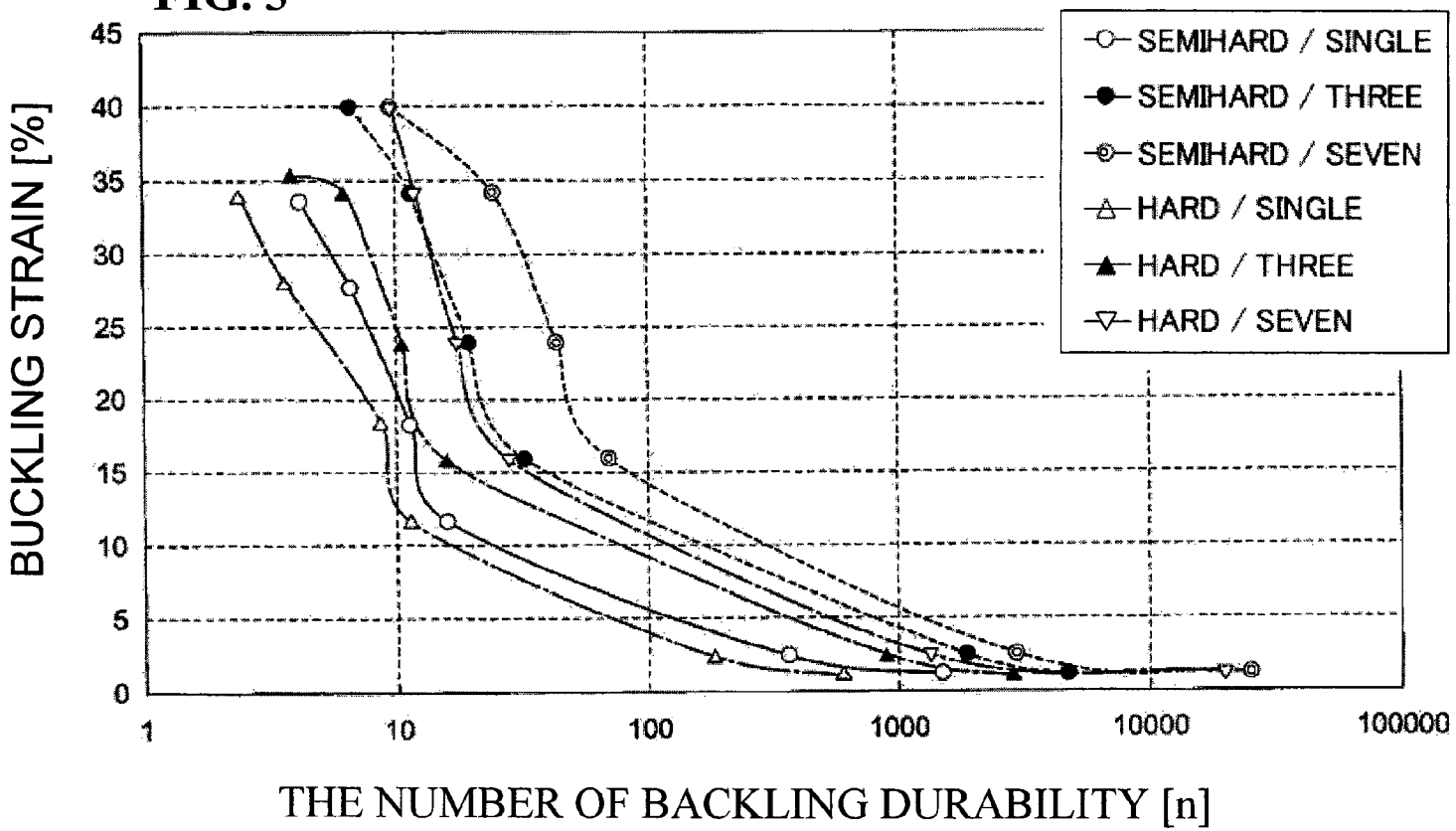
FIG. 3 is a graph showing a relationship between the durable buckling number and the buckling strain.
Figure 4:
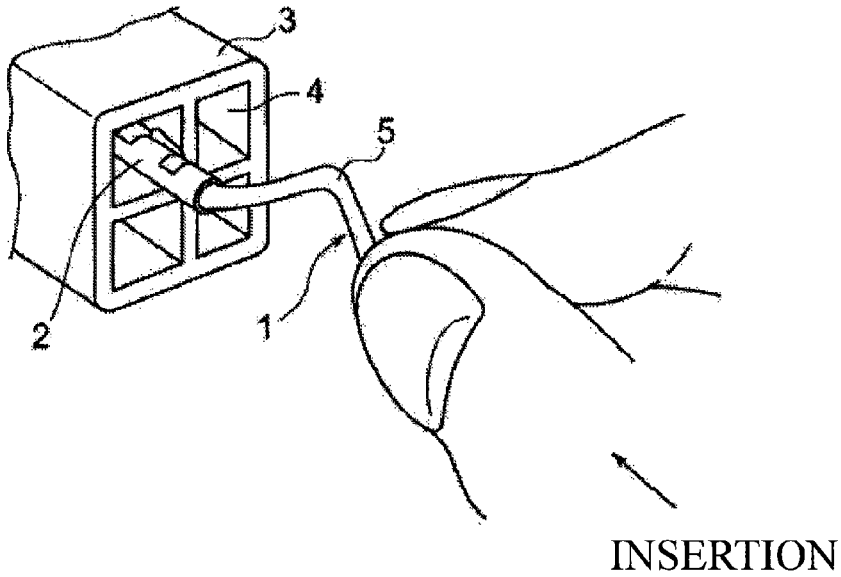
FIG. 4 is a figure showing the problematic situation for the ultrafine wire with small buckling load of the related art.

Advantages of the ultrafine wire 11 of the exemplary embodiment are explained below with reference to FIGS. 2A, 2B and 3. FIG. 2A is a graph showing a relationship between conductor configurations and respective buckling load. FIG. 2B is a graph showing a relationship between conductor configurations and respective adhesion. FIG. 3 is a graph showing a relationship between the durable buckling number and the buckling strain.

In the graph of FIG. 2A, the horizontal axis shows the configuration of the conductor and the vertical axis shows the buckling load (N). The component of the horizontal axis labeled as "three wires/ϕ0.201" corresponds to the above described ultrafine wire 11 of the exemplary embodiment. That is the conductor formed by twisting the three wires of 0.201 mm diameters and the packing factor is 80% to 83%. For a comparison, there are two examples labeled as "single wire/ϕ0.320" (first example) and "seven wires/ϕ0.127" (second example). The first example is a conductor formed from a single wire of 0.320 mm diameter. The second example is a conductor formed from twisted seven wires of 0.127 mm diameters. In these two examples, the compressing process is not performed.

The buckling load is measured as a load by applying which the above manufactured ultrafine wire is buckled. Each conductor shown in FIG. 2A is formed from a wire made from a hard copper alloy or formed from a wire made from a semihard copper alloy (The tough-pitch copper is not used). As an example of such copper alloys is a hard copper alloy including tin at 0.3 weight percent, a precipitation strengthening type alloy by an aging treatment, and the like. The hard copper alloy has high strength and low ductility and the precipitation strengthening type alloy has intermediate or high strength and ductility.

According to FIG. 2A, the ultrafine wire 11 of the exemplary embodiment less tend to be buckled as compared to the second example. (The second example uses the conductor formed from twisted seven wires of 0.127 mm diameters)

In the graph of FIG. 2B, the horizontal axis show the configuration of the conductor and the vertical axis shows the adhesion (N). The horizontal axis is same as that of FIG. 2A. The definition of the adhesion is a force by which the conductor and the insulator of the ultrafine wire are intimately contacted each other. Each conductor is formed from a wire made of hard copper alloy and a wire made from semihard copper alloy.

According to FIG. 2B, the ultrafine wire 11 of the exemplary embodiment has larger adhesion as compared to the first example. (The first example uses the conductor formed from the single wire of 0.320 mm diameter).

The graph of FIG. 3 is obtained by using each kind of ultrafine wires formed from respective conductors. The respective conductors are formed in above described configuration and are formed from above described wire materials. The horizontal axis show the number of buckling durability (n) and the vertical axis shows the buckling strain $\epsilon$(%).

According to FIG. 3, the buckling durability is secured for the ultrafine wire 11 of the exemplary embodiment.

As described above with reference to FIGS. 1 to 3 and Table 1, the ultrafine wire 11, which is manufactured according to the exemplary embodiment of the present invention, secures good workability for the terminal insertion by deterring buckling of the ultrafine wire 11 during the terminal insertion into the connector housing, and secures good buckling characteristics.

While the present invention has been shown and described with reference to certain exemplary embodiments thereof, it will be understood by those skilled in the art that various changes in form and details may be made therein without departing from the spirit and scope of the invention as defined by the appended claims.

For example, although the diameter of the wire is 0.201 mm in the above described exemplary embodiment, this is an example of the diameter and does not necessarily require correspondence in practice.

TABLE 1

| COMPRESSING DIE'S DIAMETER [mm] | COMPRESSING HOLE CROSSSECTION [mm] | CONDUCTOR'S CROSSSECTION AFTER COMPRESSION [mm] | PACKING FACTOR [%] | ANNEALED TOUCH-PITCH COPPER | HARD TOUCH-PITCH COPPER | REASON FOR NG JUDGE |
|---|---|---|---|---|---|---|
| ϕ 0.433 | 0.1473 | 0.0922 | 63% | x | x | twisting comes apart |
| ϕ 0.363 | 0.1035 | 0.082 | 79% | x | x | twisting comes apart |
| ϕ 0.360 | 0.1018 | 0.0817 | 80% | ○ | ○ | |
| ϕ 0.350 | 0.0962 | 0.0782 | 81% | ○ | ○ | |
| ϕ 0.345 | 0.0935 | 0.0775 | 83% | ○ | ○ | |
| ϕ 0.340 | 0.0908 | 0.0763 | 84% | ○ | x | breakdown by compression |
| ϕ 0.330 | 0.0855 | 0.0738 | 86% | ○ | x | breakdown by compression |
| ϕ 0.323 | 0.0819 | 0.0727 | 89% | ○ | x | breakdown by compression |
| ϕ 0.303 | 0.0721 | 0.0658 | 91% | ○ | x | breakdown by compression |
| ϕ 0.283 | 0.0629 | 0.0587 | 93% | ○ | x | breakdown by compression |
| ϕ 0.277 | 0.0603 | COMPRESSION IMPOSSIBLE | — | x | x | breakdown by compression |

The invention claimed is:

1. A manufacturing method of a wire including a conductor formed from a plurality of wires, the method comprising:

twisting the plurality of wires into twisted wires;

setting a size of a compressing hole of a compressing die such that a packing factor determined as a ratio between a cross section area of the conductor to be formed by compressing and an area of the compressing hole is 80% to 83%; and forming the conductor by compressing the twisted wires through the compressing hole of the compressing die.

2. The manufacturing method according to claim 1, wherein the plurality of wires are made from a tough-pitch copper.

3. The manufacturing method according to claim 2, wherein the plurality of wires are made from an annealed tough-pitch copper.

4. The manufacturing method according to claim 2, wherein the plurality of wires are made from a hard tough-pitch copper.

5. The manufacturing method according to claim 1, wherein the plurality of wires are made from a hard copper alloy.

6. The manufacturing method according to claim 5, wherein the hard copper alloy includes tin at 0.3 weight percent.

7. The manufacturing method according to claim 1, wherein the plurality of wires are made from a semihard copper alloy.

8. A wire comprising:

a conductor manufactured by the method according to claim 1.

* * * * *